US007530237B2

(12) United States Patent
Lei

(10) Patent No.: US 7,530,237 B2
(45) Date of Patent: May 12, 2009

(54) EARRING WITH A THREADED STEM FOR ATTACHING TO ONE OF A VARIETY OF DECORATIVE ELEMENTS

(76) Inventor: Lung Hsing Lei, 7F, 66-2, Yucheng Street, Taipei (TW)

( * ) Notice: Subject to any disclaimer, the term of this patent is extended or adjusted under 35 U.S.C. 154(b) by 33 days.

(21) Appl. No.: 11/772,830

(22) Filed: Jul. 3, 2007

(65) Prior Publication Data

US 2009/0007598 A1 Jan. 8, 2009

(51) Int. Cl.
*A44C 7/00* (2006.01)

(52) U.S. Cl. ..... 63/12; 24/705; 63/20; 63/40

(58) Field of Classification Search ..... None
See application file for complete search history.

(56) References Cited

U.S. PATENT DOCUMENTS 3,504,507 A * 4/1970 Ferro ..... 63/12
4,195,492 A * 4/1980 Johnson ..... 63/12

* cited by examiner

*Primary Examiner*—Jack W. Lavinder

(57) ABSTRACT

In one embodiment an earring includes a stem including a sharp end, external threads at the opposite end, a flange proximate the external threads, and a neck interconnecting the external threads and the flange; and a decorative member including a threaded axial opening adapted to urge its mouth against the flange by threadedly securing to the external threads. In another embodiment, the decorative member is a two-piece member. The decorative element can be implemented as one of a plurality of different shapes. Moreover, the stem can be sterilized effectively by detaching from the decorative element.

1 Claim, 6 Drawing Sheets

EARRING WITH A THREADED STEM FOR ATTACHING TO ONE OF A VARIETY OF DECORATIVE ELEMENTS

BACKGROUND OF THE INVENTION

1. Field of Invention

The invention relates to earrings, and more particularly to an earring having an externally threaded stem at one end adapted to secure to internal threads of one of a variety of decorative elements.

2. Description of Related Art

A conventional earring is shown in FIG. 1 and comprises a stem 10 having a sharp end, and a bowl-shaped stud 11 integrally formed with the stem 10.

However, the well known earring suffers from a couple of disadvantages. For example, the stud 11 as a decorative element of the earring has a fixed shape. Unfortunately, such type of earring is not attractive to most consumers. Further, it is highly possible of infecting the earlobe because the sterilization of the stem 10 cannot be done completely due to the integral construction of the earring.

There have been numerous suggestions in prior patents for. For example, U.S. Pat. No. 5,018,365 discloses an earring device having a stem with external threads and an internally threaded sleeve adapted to secure to the stem. Thus, continuing improvements in the exploitation of high quality earring are constantly being sought.

SUMMARY OF THE INVENTION

It is therefore one object of the invention to provide an earring having an externally threaded stem at one end adapted to secure to internal threads of one of a variety of decorative elements. Moreover, the stem can be sterilized completely effectively by detaching from the attached decorative element.

The above and other objects, features and advantages of the invention will become apparent from the following detailed description taken with the accompanying drawings.

DETAILED DESCRIPTION OF THE INVENTION

Figure 1:
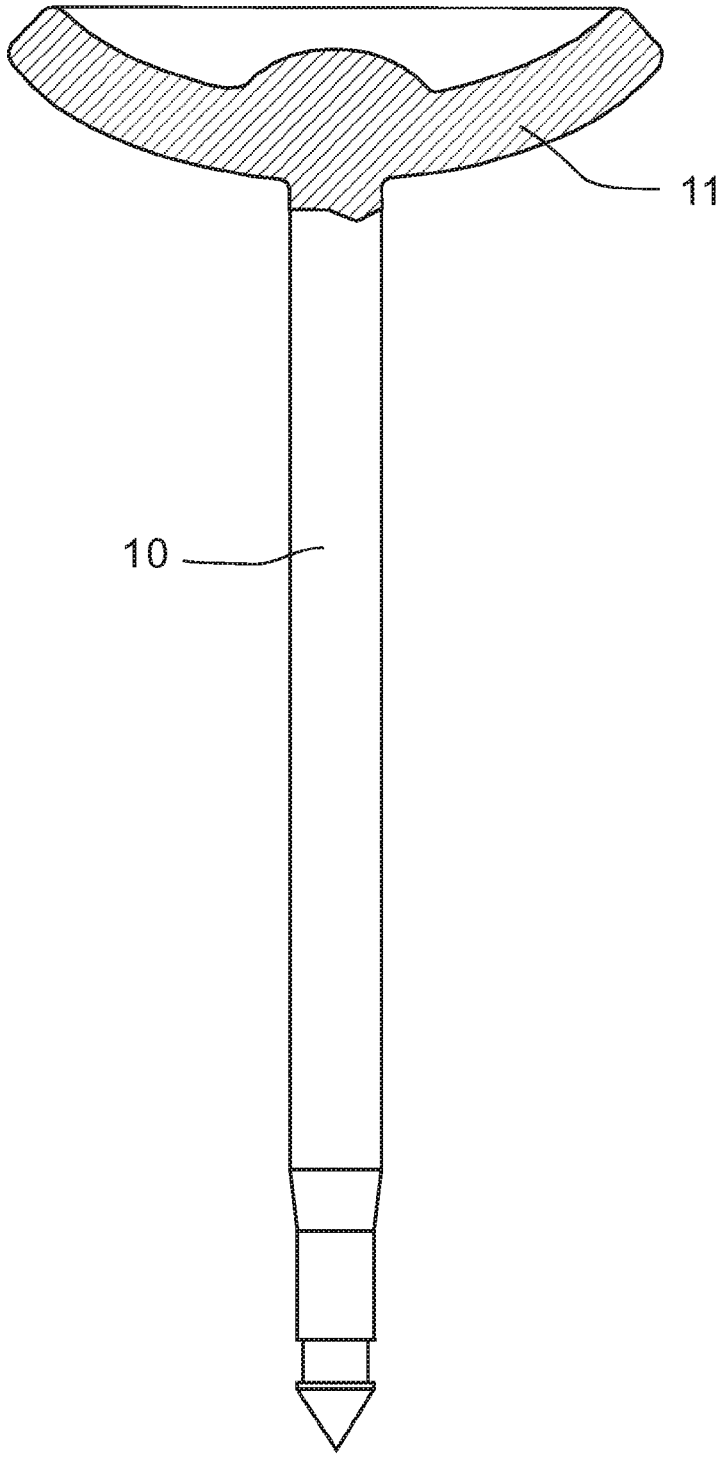
FIG. 1 PRIOR ART
FIG. 1 is a side elevation in part section of a conventional integral earring.
Figure 2:
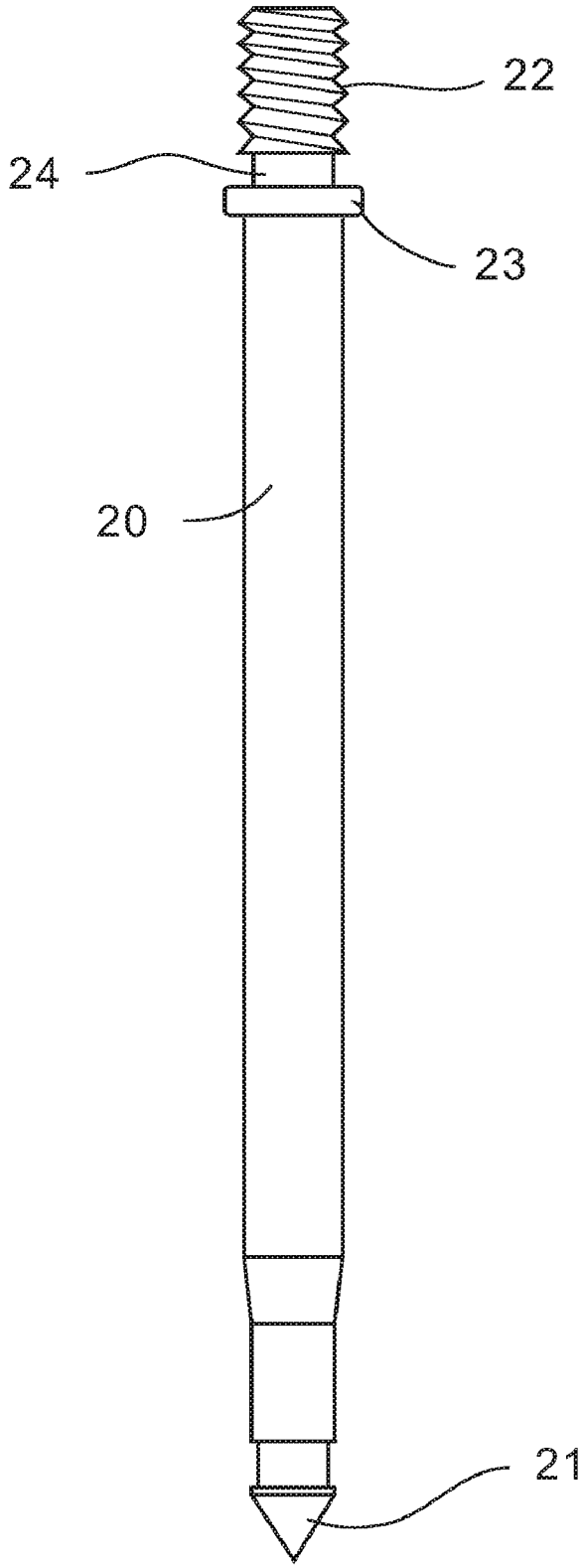
FIG. 2 is a side elevation of stem of an earring according to the invention.

Referring to FIG. 2 a stem 20 of an earring in accordance with the invention is shown. The stem 20 can be made hollow or solid and comprises a sharp portion 21 at one end, external threads 22 at the other end, an annular flange 23 proximate the external threads 22, and a neck 24 interconnecting the external threads 22 and the flange 23. In use, a person can insert the stem 20 through the earlobe by piercing by means of the sharp end 21 until a decorative element attached to the external threads 22 abuts one side of the earlobe for fastening.

Figure 3:
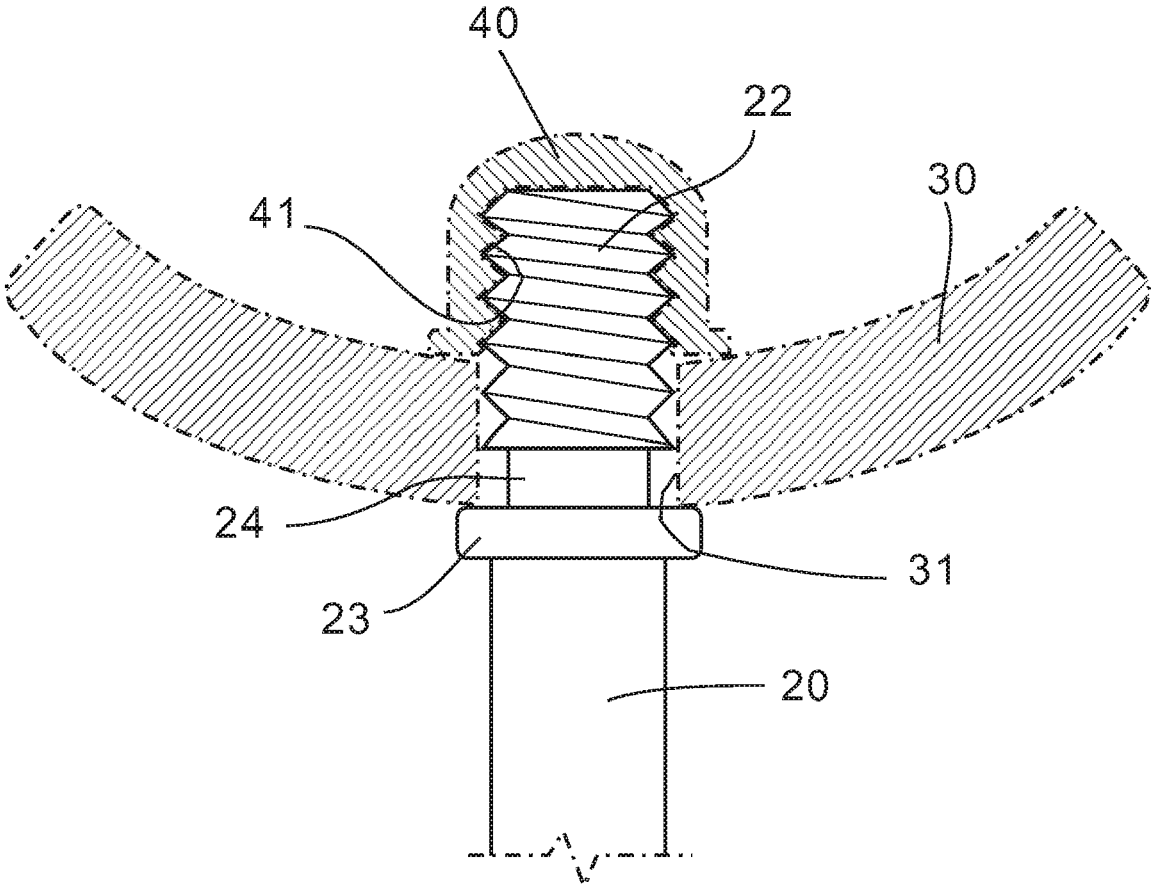
FIG. 3 is a side elevation of an upper portion of the stem of FIG. 2 showing a threaded securement of the stem and a first different decorative element by means of an outer front sleeve according to a first preferred embodiment of the invention.

Referring to FIG. 3, a first preferred embodiment of securing the stem 20 to a first different decorative element according to the invention is shown. A bowl-shaped decorative element 30 has a center opening 31 dimensioned and shaped to put snugly on the neck 24 and an adjacent portion of the external threads 22 and is adapted to seat on the flange 23 for positioning. An outer front sleeve 40 has a threaded axial opening 41 with a ring-shaped flange (not numbered) at its rear end. The external threads 22 are adapted to insert into the opening 41 by threading until the sleeve 40 urges against the decorative element 30 for fastening. This finishes the assembly of the earring.

Figure 4:
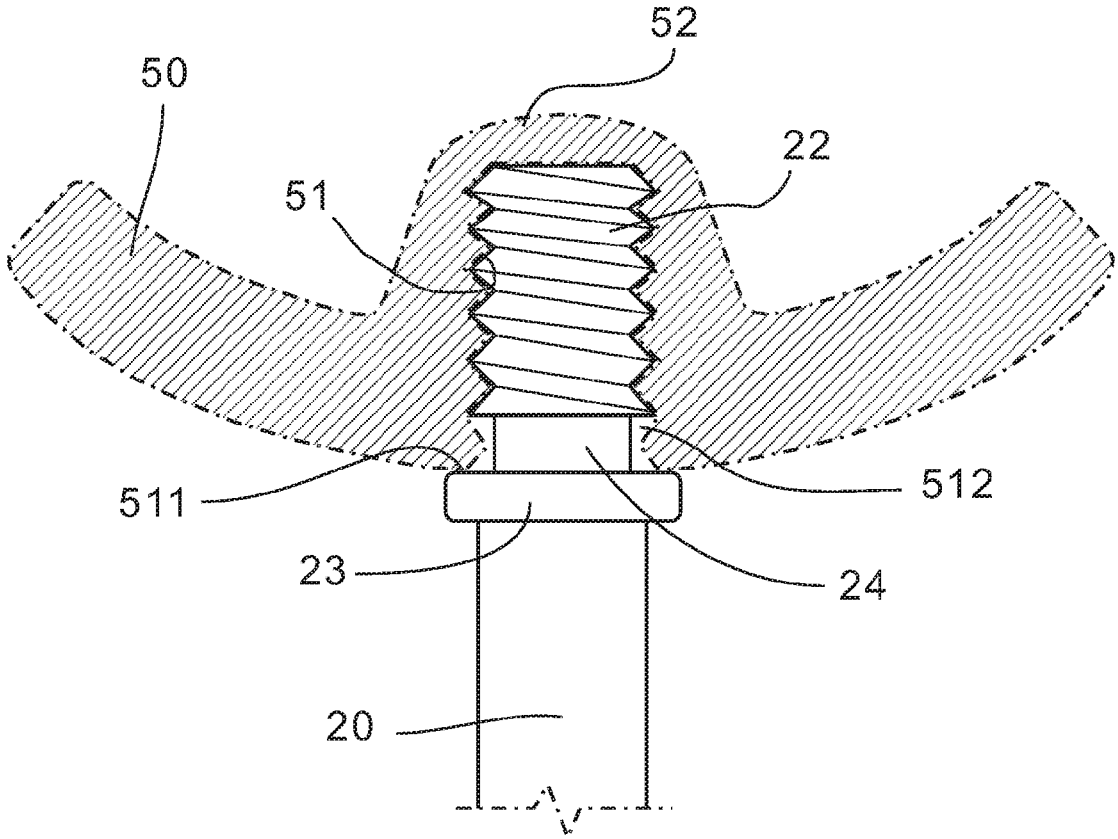
FIG. 4 is a view similar to FIG. 3 showing a threaded securement of the stem and a second different decorative element according to a second preferred embodiment of the invention.

Referring to FIG. 4, an earring according to a second preferred embodiment of the invention is shown. The characteristics of the second preferred embodiment are detailed below. A decorative element 50 is of bowl-shaped and comprises a front central raised member 52 having a threaded axial opening 51. In assembly, the external threads 22 are inserted into the opening 51 by threading until a mouth 511 of the opening 51 urges against the flange 23 for fastening. An internal space 512 is defined by the flange 23, the neck 24, the rear end of the external threads 22 and the rear thread of the opening 51.

Figure 5:
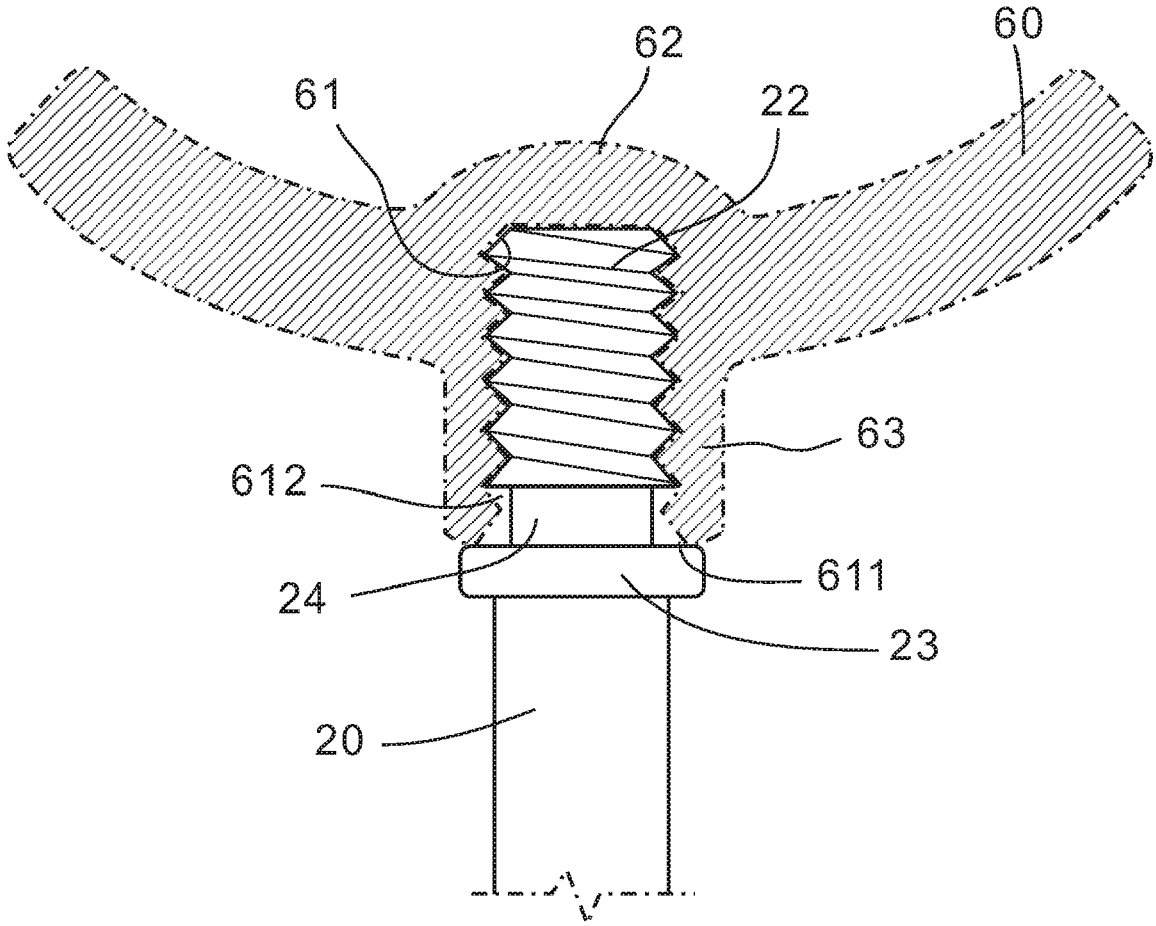
FIG. 5 is a view similar to FIG. 3 showing a threaded securement of the stem and a third different decorative element according to a third preferred embodiment of the invention.

Referring to FIG. 5, an earring according to a third preferred embodiment of the invention is shown. The characteristics of the third preferred embodiment are detailed below. A decorative element 60 is of bowl-shaped and comprises a front central raised member 62 and a rear cylindrical projection 63 with a threaded axial opening 61 terminating at about a virtual curve passing a discontinuous portion of the center of the decorative element 60 (i.e., at a joining portion of the raised member 62 and a concave inner surface of the decorative element 60) by passing the hollow projection 63. In assembly, the external threads 22 are inserted into the opening 61 by threading until a mouth 611 of the opening 61 urges against the flange 23. An internal space 612 is defined by the flange 23, the neck 24, the rear end of the external threads 22 and the rear thread of the opening 61.

Figure 6:
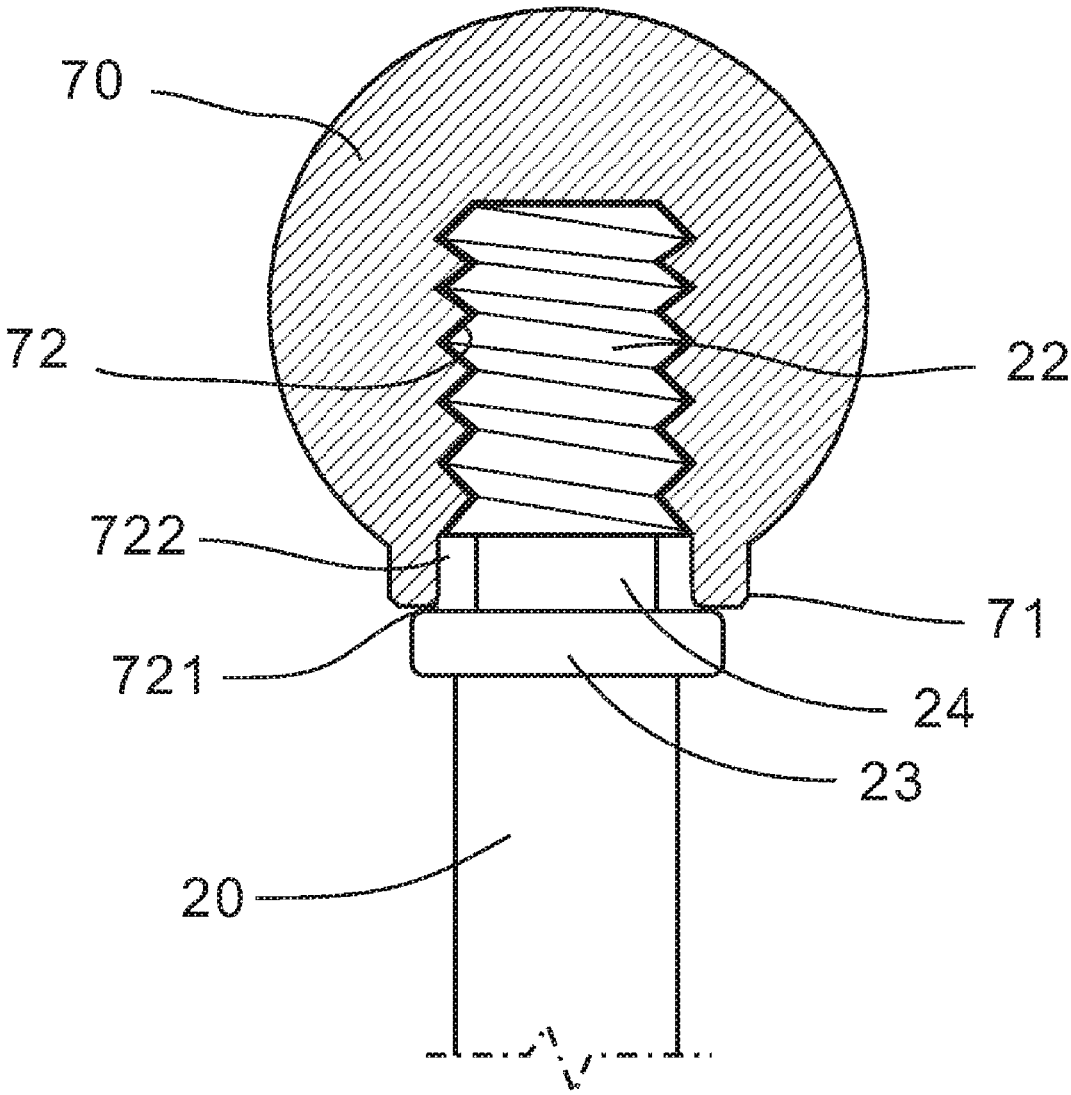
FIG. 6 is a view similar to FIG. 3 showing a threaded securement of the stem and a fourth different decorative element according to a fourth preferred embodiment of the invention.

Referring to FIG. 6, an earring according to a fourth preferred embodiment of the invention is shown. The characteristics of the fourth preferred embodiment are detailed below. A decorative element 70 is of spherical (i.e., stud earring) and comprises an annular ring-shaped flange 71 extending out of a rear portion, and a threaded axial opening 72 with the flange 71 formed around its mouth 721. In assembly, the external threads 22 are inserted into the opening 72 by threading until the mouth 721 of the opening 72 urges against the flange 23. An internal space 722 is defined by the flange 23, the neck 24, the rear end of the external threads 22, and the flange 71.

It is envisaged by the invention that the stem 20 can be sterilized individually after separating from the decorative element. Thus, the sterilization is complete and effective. Moreover, the stem 20 can be threadedly secured to one of a variety of decorative elements. Thus, an earring full of variations is effected. This feature can greatly attract people to buy this type of earring of the invention.

While the invention herein disclosed has been described by means of specific embodiments, numerous modifications and variations could be made thereto by those skilled in the art without departing from the scope and spirit of the invention set forth in the claims.

What is claimed is:

1. An earring comprising:

a stem including a sharp member at one end, external threads at the other end, a flange proximate the external threads, and a neck interconnecting the external threads and the flange;

a decorative member including a center opening adapted to put on the neck and an adjacent portion of the external threads by seating on the flange; and an outer sleeve including a threaded axial opening adapted to urge its mouth against the decorative member by threadedly securing to the external threads.

* * * * *